United States Patent [19]

Mowbray

[11] Patent Number: 4,470,398

[45] Date of Patent: Sep. 11, 1984

[54] FUEL INJECTION PUMPING APPARATUS

[75] Inventor: Dorian F. Mowbray, Burnham, England

[73] Assignee: Lucas Industries Public Limited Company, Birmingham, England

[21] Appl. No.: 469,316

[22] Filed: Feb. 24, 1983

[30] Foreign Application Priority Data

Mar. 23, 1982 [GB] United Kingdom ..... 8208399

[51] Int. Cl.[3] ..... F02M 59/20

[52] U.S. Cl. ..... 123/502; 123/501; 417/462

[58] Field of Search ..... 123/502, 501, 372, 373, 123/374, 369; 417/462

[56] References Cited

U.S. PATENT DOCUMENTS 4,050,432 9/1977 Davis et al. ..... 123/502
4,074,667 2/1978 Skinner ..... 123/502
4,226,916 9/1980 Davis ..... 123/502
4,359,995 11/1982 Mowbray ..... 123/502
4,393,846 7/1983 Mowbray et al. ..... 123/502
4,408,591 10/1983 Nakamura ..... 123/502

*Primary Examiner*—Magdalen Y. C. Moy

[57] ABSTRACT

A fuel injection pumping apparatus for supplying fuel to an internal combustion engine comprises a throttle element 21 for controlling fuel flow between a low pressure and a high pressure pump the latter delivering fuel in timed relationship to the associated engine. The high pressure pump includes a piston movable to control the timing of injection of fuel to the engine. A valve member is movable to control the pressure applied to the piston and the valve member is movable against the action of a spring by fuel pressure, and the force exerted by the spring depends on the position of a lever movable about a fulcrum. The fulcrum is adjustable by a device and the lever is movable about the fulcrum by a cam surface on a slidable member the position of which is determined by an operator adjustable member forming part of a fuel control which determines the setting of the throttle element.

4 Claims, 3 Drawing Figures

FUEL INJECTION PUMPING APPARATUS

Figure 1:
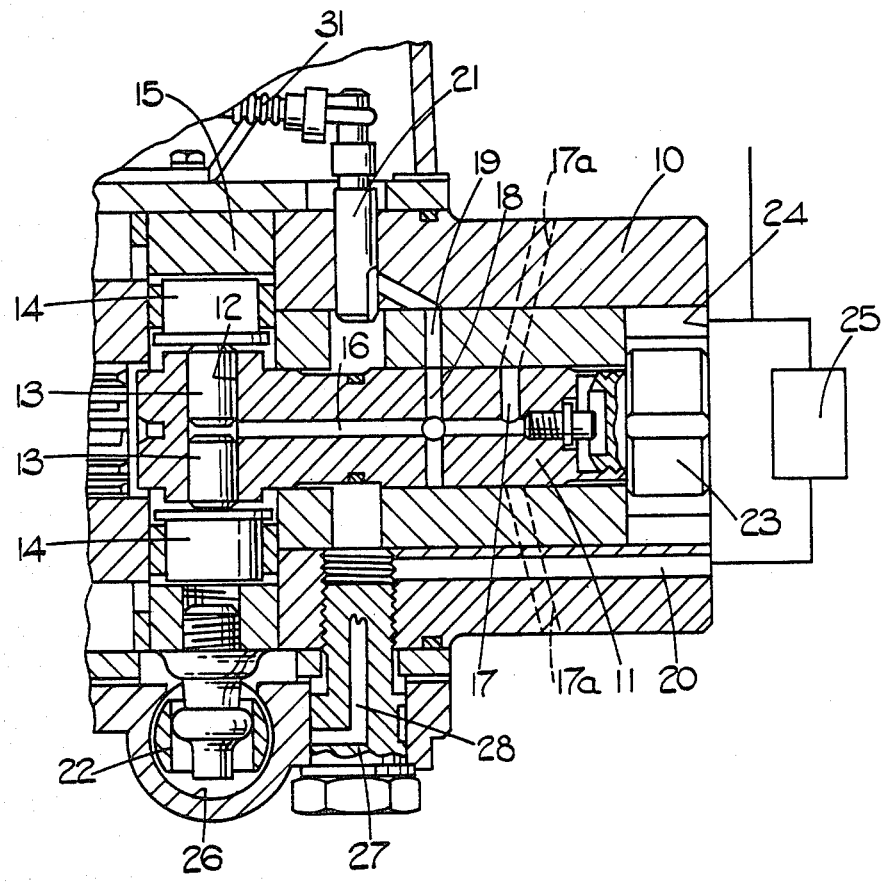

This invention relates to a fuel injection pumping apparatus for supplying fuel to an internal combustion engine and of the kind comprising an injection pump which in use delivers fuel at high pressure to an associated engine, a low pressure pump for supplying fuel to the injection pump, fuel control means disposed intermediate the pumps for controlling the flow of fuel to the injection pump and a fluid pressure operable timing adjuster for altering the setting of a component of the injection pump thereby to modify the timing of fuel delivery by the injection pump.

Such apparatus is known in the art and it is also known to provide a valve controlling the pressure applied to the timing adjuster so that the pressure can be made to vary with the setting of the fuel control means. Examples of such apparatus are shown in the Specification of British Pat. No. 978116 in which the timing adjuster is in the form of a piston and the valve includes a valve member which is loaded by a spring, the force exerted by the spring being adjustable by means of a cam surface which forms part of the fuel control means. In operation, adjustment of the fuel control means to vary the fuel quantity also varies the force exerted by the spring so that the pressure applied to the piston is varied. It is often desirable to be able to effect an adjustment in accordance with some other variable for example, engine temperature. With the apparatus described in the Specification of British Pat. No. 978116 this is not easy to achieve.

Another form of such an apparatus is known from British published Specification No. 2068591A in which the timing adjuster is in the form of a spring loaded piston and the fuel control means is coupled to mechanism which can, as the fuel control means is adjusted, alter the spring force applied to the piston. The mechanism incorporates a sliding cam plate which is coupled to the control means by a linkage system. One of the disadvantages of this arrangement is that the practical layout of the system is difficult to arrange. Furthermore, the spring force which is applied to the piston is high so that there is considerable friction and wear. The apparatus does however incorporate a movable fulcrum for a lever forming part of the linkage system whereby a further adjustment can be made which is independent of the fuel control means.

The object of the present invention is to provide a pumping apparatus of the kind specified in a simple and convenient form.

According to the invention an apparatus of the kind specified comprises a valve for controlling the pressure applied to the timing adjuster, said valve including a spring biased valve member which is subject to a fluid pressure which varies in accordance with the speed at which the apparatus is driven and which acts to move the valve member against the action of its spring, a pivotal lever one end of which is operatively connected to an abutment for the spring of the valve member, means forming part of the fuel control means for pivoting said lever thereby altering the force exerted by said spring on the valve member, and means operable to alter the position of the fulcrum of the lever.

Figure 2:
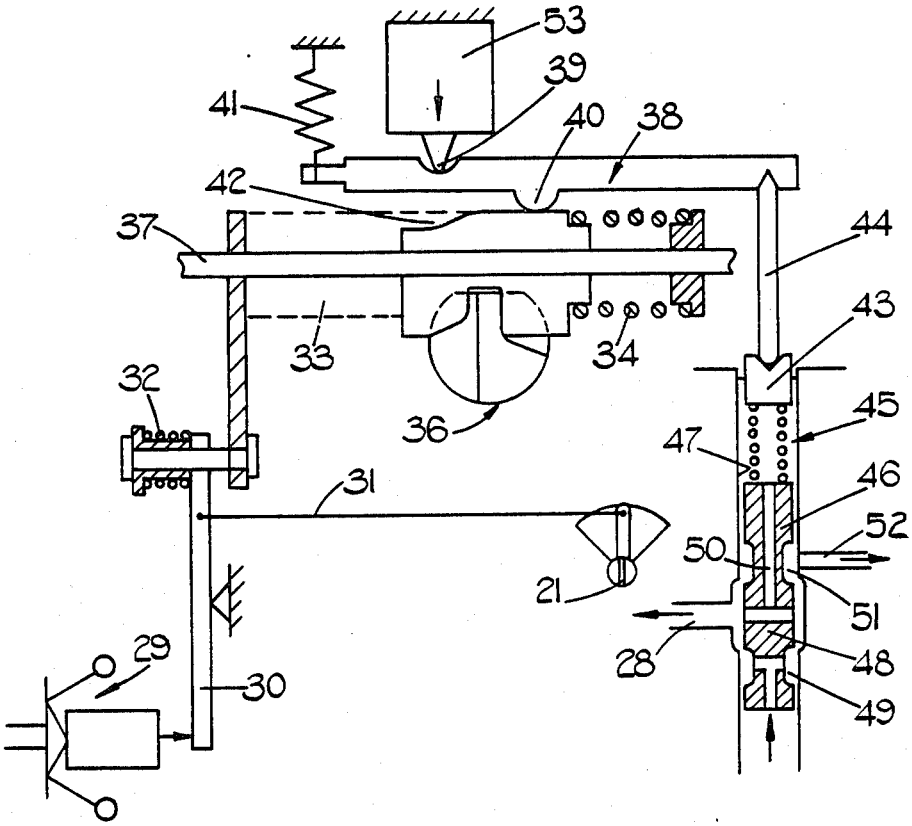
Figure 3:
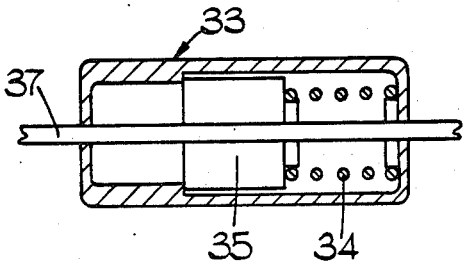

An example of an apparatus in accordance with the invention will now be described with reference to the accompanying drawings in which:

FIG. 1 is a sectional side elevation of a simple form of apparatus to which the invention may be applied, FIG. 2 is a diagrammatic view of a part of the apparatus modified in accordance with the invention; and FIG. 3 is a plan view of part of the apparatus seen in FIG. 2.

Referring to FIG. 1 of the drawings, the apparatus comprises a body 10 in which is mounted a rotary cylindrical distributor member 11. The distributor member is connected to a shaft whereby it can be driven in timed relationship with an associated engine and formed in the distributor member is a transversely extending bore 12 in which is mounted a pair of pumping plungers 13. At their outer ends, the plungers engage followers 14 which includer rollers respectively engageable with the internal peripheral surface of an angularly adjustable cam ring 15.

The bore 12 communicates with a longitudinal passage 16 formed in the distributor member and which at one point communicates with an outwardly extending delivery passage 17. This is arranged to register in turn as the distributor member rotates, with outlets 17A formed in the body and which in use, are connected to the injection nozzles respectively of the associated engine.

The passage 16 also communicates with a plurality of outwardly extending inlet passages 18 which can register in turn with an inlet port 19 formed in the body. Also located in the body is fuel control means in the form of a throttle element 21 through which fuel flowing through a passage 20 can flow to the inlet port 19.

The passage 20 communicates with the outlet of a low pressure fuel supply pump 23 which has an inlet 24. The rotary part of the supply pump is driven from the distributor member and the inlet and outlet are interconnected by a relief valve 25 which acts to control the output pressure so that it varies in accordance with the speed at which the apparatus is driven.

The plungers 13 constitute the pumping elements of an injection pump and with the setting of the distributor member as shown in FIG. 1, fuel is being supplied by way of the passage 20, the throttle member 21 and the inlet port 19, to the bore 12. As the distributor member rotates communication of the inlet port with one of the inlet passages is broken and the delivery passage 17 moves into register with one of the outlets 17A. Inward movement is now imparted to the plungers by way of the cam followers 14, by means of cam lobes formed on the internal peripheral surface of the cam ring and as the plungers are moved inwardly, fuel is displaced from the bore 12 and flows by way of the passages 16 and 17 to an outlet 17A. The cycle is repeated as the distributor member is further rotated and fuel is supplied to the outlets in turn, the quantity of fuel being determined by the setting of the throttle element 21.

With the form of pump described the timing of the start of delivery of fuel to the associated engine depends upon the quantity of fuel present in the bore 12 at the end of the filling period. The greater the quantity of fuel in the bore then the further out will be the plungers 13 and hence the cam lobes will start to move the plungers inwardly earlier in the cycle. The timing of delivery therefore advances as the quantity of fuel supplied to the engine increases.

In order to vary irrespective of fuel quantity, the timing of delivery of fuel to the associated engine, a component of the injection pump is adjustable and in this case the component is the cam ring 15. The cam ring is angularly adjustable within the body and for this purpose it is connected by means of a radially disposed peg, to a piston 22 which is located within a cylinder 26 which is formed in a part secured to the body by means of a bolt 27 which also serves to provide a fuel connection to the cylinder by way of a passage 28.

The throttle element 21 is angularly adjustable within a bore to control by means of a groove formed in its side wall, the flow of fuel from the pump 23 to the injection pump. For this purpose, the throttle member is angularly adjustable and will in practice, be connected to an engine speed governor which may be of the so-called "all-speed" type.

Turning now to FIGS. 2 and 3 a two speed governor arrangement is shown which includes a centrifugal weight unit 29 which acts upon one end of a pivotal lever 30 to move the lever in the anti-clockwise direction with increasing speed. The other end of the lever is connected by a link 31 to the throttle element 21. The aforesaid other end of the link is coupled through an idling control spring 32 to a slidable frame 33 which serves as an abutment for one end of a maximum speed control spring 34 the other end of which engages a slidable block 35. The axial position of the block 35 is determined by an operator adjustable member 36 and the block and frame define stop surfaces to determine the pre-stress of the spring 34. The frame and block are guided by a rod 37 fixed in the housing of the apparatus.

In operation, at idling speeds, the force developed by the weight unit will be balanced by the force exerted by the spring 32 to control the idling speed of the associated engine. The amount of fuel supplied to the engine in the intermediate speed range is determined by the position of the block 35 which in turn is controlled by the operator. Irrespective of the setting of the block in the event that the engine speed attains its maximum allowed value the force exerted by the spring 34 will be overcome by the force exerted by the weight unit and the frame and lever 30 will be moved to effect a reduction in the amount of fuel supplied to the engine.

The apparatus also includes a pivotal lever 38 which is pivotally mounted about a fulcrum 39 on the remote side of the lever 38 from the block 35. The lever 38 has a projection 40 which by means of a coiled tension spring 41 is maintained in contact with a cam surface 42 defined on the block.

The end of the lever 38 remote from the spring 41 is operatively connected to a spring abutment 43, abutment 43 forms a spring abutment for a light coiled compression spring 45 which engages one end of a valve member 46 forming part of a valve which controls the pressure applied to the piston 22. The valve member 46 is located within a bore 47 from which extends the passage 28 and the end of the bore remote from the abutment communicates with the pump 23 so that the pressure developed by the pump is applied to the valve member in opposition to the spring 45. The port 28 extends from an enlarged portion of the bore 47 in which the valve member 46 is provided with a land 48 which controls the pressure in the passage 28 depending upon the axial position of the valve member 46. For this purpose, the groove 49 on the side of the land remote from the spring 45, is connected by means of an internal passage to receive fuel from the outlet of the low pressure pump. Moreover, the end of the valve member engaged by the spring 45, is exposed to the pressure in the passage 28 by means of a drilling 50 in the valve member. A further groove 51 is formed in the valve member on the side of the land 48 closer to the spring 45 and this groove by way of a passage 52, communicates with a drain conveniently the inlet of the low pressure supply pump.

Considering the operation of the portion of the apparatus shown in FIG. 2 so far described. Assuming for the moment that the setting of the block 35 does not vary. As the speed at which the apparatus operates increases, so the fuel pressure applied to the valve member 46 will increase to move the valve member a small distance against the action of the spring 45. As a result the pressure in the passage 28 will also increase because the groove 49 will move further into register with the enlargement of the bore while the groove 51 will tend to move out of register therewith. As a result the pressure applied to the piston 22 increases and the cam ring will be moved to advance the timing of delivery of fuel. Conversely, if the speed should fall the pressure in the passage 28 will decrease. The movement of the valve member 46 will be very small because it is force balanced and only a small movement is required to effect a considerable change in the pressure in the passage 28. If now for a constant speed, the block 35 is moved to increase the quantity of fuel then depending upon the profile of the cam surface 42, the lever 38 will pivot to adjust the position of the abutment 43. This will alter the force balance on the valve member which will move slightly to vary the pressure and to restore the force balance. The varied pressure is applied to the piston 22. The profile 42 can be of any desired form to achieve the required adjustment of the cam ring. It should be pointed out that the spring 45 is weaker than the spring 41 so that the lever 38 will not pivot due to variations in the force exerted by the spring 45.

The fulcrum 39 is adjustably mounted so that a further adjustment of the abutment 43 is possible without a variation in the setting of the block or a variation in the speed.

In the example the fulcrum 39 is mounted upon the output member of an electromagnetic device generally indicated at 53 and this device can be energised in accordance with for example the engine operating temperature. Thus if the engine is cold the fulcrum 39 will be extended from the position in which it is shown to pivot the lever in an anti-clockwise direction, thereby to reduce the force exerted by the spring 45. With a reduced spring force, the valve member 46 will operate to increase the pressure applied to the piston 22.

As described a step change in the position of the fulcrum is obtained. It will be appreciated that the fulcrum movement can be progressive if so required. Moreover, other forms of mechanism may be utilised to position the fulcrum and the actual position of the fulcrum can be determined by parameters other than temperature or a combination of parameters.

I claim:

1. A fuel injection pumping apparatus for supplying fuel to an internal combustion engine comprising an injection pump which in use delivers fuel at high pressure to an associated engine, a low pressure pump for supplying fuel to the injection pump, fuel control means disposed intermediate the pumps for controlling the flow of fuel to the injection pump, a fluid pressure operable timing adjuster for altering the setting of a component of the injection pump thereby to modify the timing of fuel delivery by the injection pump, a valve for controlling the pressure applied to the timing adjuster, said valve including a spring biased valve member which is subject to a fluid pressure which varies in accordance with the speed at which the apparatus is driven and which acts to move the valve member against the action of its spring, a pivotal lever one end of which is operatively connected to an abutment for the spring of the valve member, means forming part of the fuel control means for pivoting said lever thereby altering the force exerted by said spring on the valve member, and means operable to alter the position of the fulcrum of the lever.

2. An apparatus according to claim 1 in which the means coupled to the fuel control means comprises a member defining a cam surface, and a pivot for said lever, said pivot being engageable with said cam surface and said member being movably mounted in the direction in which said lever extends.

3. An apparatus according to claim 2 in which said fuel control means includes an engine speed responsive mechanism, a fuel control element for controlling the fuel flow between the low pressure and high pressure pumps, said fuel control element being coupled to said speed responsive mechanism, in the sense that as the speed increases the element will be moved to reduce the amount of fuel supplied to the engine, a preloaded governor spring for opposing said movement, said member forming an abutment for said spring and manually operable means for adjusting the setting of said member.

4. An apparatus according to claim 3 in which the means operable to alter the position of the fulcrum of the lever comprises an electromagnetic device.

* * * * *